US006508158B2

(12) United States Patent
Murello

(10) Patent No.: US 6,508,158 B2
(45) Date of Patent: Jan. 21, 2003

(54) FIRING LEVER ARRANGEMENT FOR A FIREARM

(75) Inventor: Johannes Murello, Deisslingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/916,960

(22) Filed: Jul. 27, 2001

(65) Prior Publication Data

US 2002/0046642 A1 Apr. 25, 2002

Related U.S. Application Data

(63) Continuation of application No. PCT/EP00/00642, filed on Jan. 27, 2000.

(30) Foreign Application Priority Data

Jan. 28, 1999 (DE) ..... 199 03 321

(51) Int. Cl.[7] ..... F41A 3/72; F41A 35/06
(52) U.S. Cl. ..... 89/1.42
(58) Field of Search ..... 89/1.42; 42/16

(56) References Cited

U.S. PATENT DOCUMENTS

| | | | | |
|---|---|---|---|---|
| 3,341,963 A | * | 9/1967 | Seiderman | 42/16 |
| 3,776,096 A | | 12/1973 | Donovan | 89/174 |
| 3,791,060 A | * | 2/1974 | Weaver | 42/16 |
| 4,502,367 A | | 3/1985 | Sullivan | 89/181 |
| 5,606,825 A | | 3/1997 | Olsen | 42/69.01 |
| 5,821,445 A | * | 10/1998 | Guhring | 42/16 |

FOREIGN PATENT DOCUMENTS

| | | | |
|---|---|---|---|
| DE | 1453923 | | 8/1969 |
| DE | 9419743 | | 4/1996 |
| GB | 2356241 A | * | 5/2001 |

OTHER PUBLICATIONS

*International Search Report* (and English–language translation) corresponding to International Patent Application Ser. No. PCT/EP00/00642, European Patent Office, dated May 16, 2000, 3 pages.

*International Preliminary Examination Report* (and English–language translation) corresponding to International Patent Application Ser. No. PCT/EP00/00642, International Bureau of WIPO, dated Apr. 27, 2001, 6 pages.

* cited by examiner

*Primary Examiner*—Charles T. Jordan
*Assistant Examiner*—John W. Zerr
(74) *Attorney, Agent, or Firm*—Marshall, Gerstein & Borun

(57) ABSTRACT

A firing lever assembly is disclosed for use in a firearm having a housing extending in a longitudinal direction and a bolt assembly adapted for longitudinal movement within the housing. The firing lever assembly includes a carrier defining a through hole and a firing lever having a first end adapted for insertion into the carrier. A spring guide rod is sized for insertion into the carrier through hole and adapted for longitudinal movement between an extended position and a retracted position, and a recoil spring disposed about the spring guide rod. The spring guide rod in the extended position engages the firing lever to secure the first end of the firing lever in the carrier, while the spring guide rod in the retracted position is disengaged from the firing lever to allow removal of the firing lever from the carrier.

17 Claims, 4 Drawing Sheets

FIRING LEVER ARRANGEMENT FOR A FIREARM

RELATED APPLICATION

This patent is a continuation and claims priority under 35 U.S.C. §120 from International Application No. PCT/EP00/00642, which was filed on Jan. 27, 2000.

FIELD OF THE INVENTION

The invention relates generally to firearms, and, more particularly, to firearms including a firing lever that may be mounted on either side of a carrier as desired by the shooter of the firearm.

BACKGROUND OF THE INVENTION

A firing lever arrangement is generally described in German Patent No. DE 14 53 923 A (as well as DE 94 19 743 U1). The term "bolt assembly" as used herein also means parts directly connected to the bolt assembly or also parts of the bolt assembly, for example, the bolt carrier.

The position terms used in this patent, like "forward", "top", etc., always assume a weapon in the normal firing position; (i.e., a weapon position in which the center axis of the barrel of the weapon runs generally horizontally and the direction of firing points "forward" away from the shooter).

Traditionally, automatic weapons or submachine guns are generally designed only for right-handed use. The firing lever is generally mounted directly on the bolt carrier or bolt assembly and protrudes laterally from the weapon housing. During shooting, the firing lever follows the forward and backward movements of the bolt assembly. The firing lever is traditionally placed on the right side, i.e., the side corresponding to the use hand when the weapon is used by a right-handed shooter. An example of this is the Soviet AK-47 assault rifle (Kalaschnikow). Left-handed use of such a weapon is possible, but awkward.

Weapons are now known in which the firing lever is positioned on the left side. However, these weapons are also primarily intended for right-handed use. Thus, in the G3 rifle of the German Army, the firing lever is mounted separately from the bolt assembly on the left side of the weapon. Thus, during shooting, the firing lever remains fixed. This arrangement permits right-handed shooters to reload the weapon with the left hand without having to take their right hand from the grip. A left-handed shooter, however, must regrip the weapon during reloading. The time required for him to make the weapon ready to shoot again is therefore increased. The risk that the shooter will be unarmed in combat during this period is therefore higher.

The drawbacks that follow from left-handed use of right-handed weapons compel left-handed shooters in military service to relearn use of the right hand in right-handed weapons. This is quite reasonable in light of the desired standardization of equipment. However, accuracy and safe handling of the weapon by left-handed shooters can be substantially improved if weapons for left-handed use are made available to them.

Weapons in which the firing lever is arranged in the center represent a compromise in this context, as, for example, in the Israeli Uzi submachine gun. However, an arrangement that permits optimal right- or left-handed use, as required, appears to be much more favorable. An example of this is known from DE 196 13 987 A1 (Heckler & Koch). The firing lever arrangement shown there has a firing lever lying freely above the weapon housing and may be pivoted around a vertical pin. Accordingly, the firing lever may be pivoted to the right or left for reloading, and a locking device is provided for holding the firing lever in the rightward or leftward pivoted out position. By releasing the lock, the firing lever retracts to its longitudinal position by a return spring. The firing lever assumes this position during firing of the weapon and is then moved back and forth together with the bolt assembly. This type of arrangement enables the shooter to operate the firing lever on the side most favorable for him, i.e., right- or left-handed.

Locking of the firing lever makes it possible to apply a high force on the bolt assembly via the locking lever, in both the opening and closing direction. This is particularly advantageous for functional disturbances that can only be eliminated by forcible closing of the bolt assembly such as, for example, when a cartridge jams in the cartridge chamber. Other weapons, for example the aforementioned G3, do not permit such an expedient or require additional designs.

Left-handed use of a firearm additionally presumes an appropriate casing ejection, in addition to the appropriate lever arrangement. During shooting, empty casings are typically ejected to the right. A left-handed shooter therefore runs the risk of being struck on the right arm by the casings. In firearms of the so-called bullpup design, the magazine is positioned behind (instead of in front of) the trigger. The casing ejector arranged above the magazine is, therefore, situated next to or right in front of the face when the weapon is aimed. Ejected casings in a right-handed weapon would therefore fly directly against the head or into the face of a left-handed shooter. In this case, casing ejection must be rearranged to the left for left-handed use of the weapon, and therefore ejection openings must be provided on both sides for both-sided use of the weapon. However, when ejection openings are provided on both sides of the weapon, it is not readily apparent from an external examination as to how the casing ejection is set up (i.e., on which side the casings will be ejected during shooting).

The firing lever arrangement known from DE 196 13 987 A1 of the applicant, in combination with an adjustable casing ejection, alternately permits right- and left-handed use of the weapon. The firing lever is retracted when not in use to lay along the direction of the weapon, and therefore this position of the firing lever does not indicate whether the weapon is set up for right- or left-handed use (i.e., does not indicate how the casing ejection is oriented). The external appearance of a weapon configured for left-handed use, therefore, has the same external appearance as one configured for right-handed use. This can lead to confusion, which can result in significant burdens or even injuries due to casings being ejected in unexpected directions. This hazard must be countered with increased precautionary measures during issuing of weapons or with appropriate marking of the weapons. The furnishing of left-hand weapons is therefore connected with additional expense. Accordingly, it would be advantageous to provide a firearm having the firing lever arrangement that indicates whether the corresponding firearm is set up for right- or left-handed use.

A modern front loading weapon with convertible firing lever is shown in U.S. Pat. No. 5,606,825, but the purpose and general design of this type of front loading firing lever is fully different from one set up for individual cartridges, i.e., from the firing lever of an automatic weapon or submachine gun.

SUMMARY OF THE INVENTION

In accordance with the teachings of the present invention, a firearm is provided having an elongate housing defining a longitudinal direction and a bolt assembly disposed inside the housing and adapted for movement in the longitudinal direction. A carrier is provided that defines a through hole oriented in the longitudinal direction. A spring guide rod extends in the longitudinal direction and is sized for insertion through the carrier through hole, the spring guide rod being movable between a retracted position and an extended position, while a recoil spring is disposed along the spring guide rod. A firing lever has a first end adapted for insertion into the carrier and defines a first retaining hole sized to receive the spring guide rod. The spring guide rod in the extended position passes through the firing lever first retaining hole to secure the firing lever in place, while the spring guide rod in the retracted position is withdrawn from the firing lever first retaining hole to allow removal of the firing lever from the carrier.

Further in accordance with the teachings of the present invention, a firing lever assembly is provided for use in a firearm having a housing extending in a longitudinal direction and a bolt assembly adapted for longitudinal movement within the housing. The firing lever assembly includes a carrier defining a through hole and a firing lever having a first end adapted for insertion into the carrier. A spring guide rod is sized for insertion into the carrier through hole and adapted for longitudinal movement between an extended position and a retracted position, and a recoil spring disposed about the spring guide rod. The spring guide rod in the extended position engages the firing lever to secure the first end of the firing lever in the carrier, while the spring guide rod in the retracted position is disengaged from the firing lever to allow removal of the firing lever from the carrier.

BRIEF DESCRIPTION OF THE DRAWINGS

Identical reference numbers refer to the same elements throughout the figures.

DESCRIPTION OF THE PREFERRED EMBODIMENTS

Figures 1A, 1B, 1C:
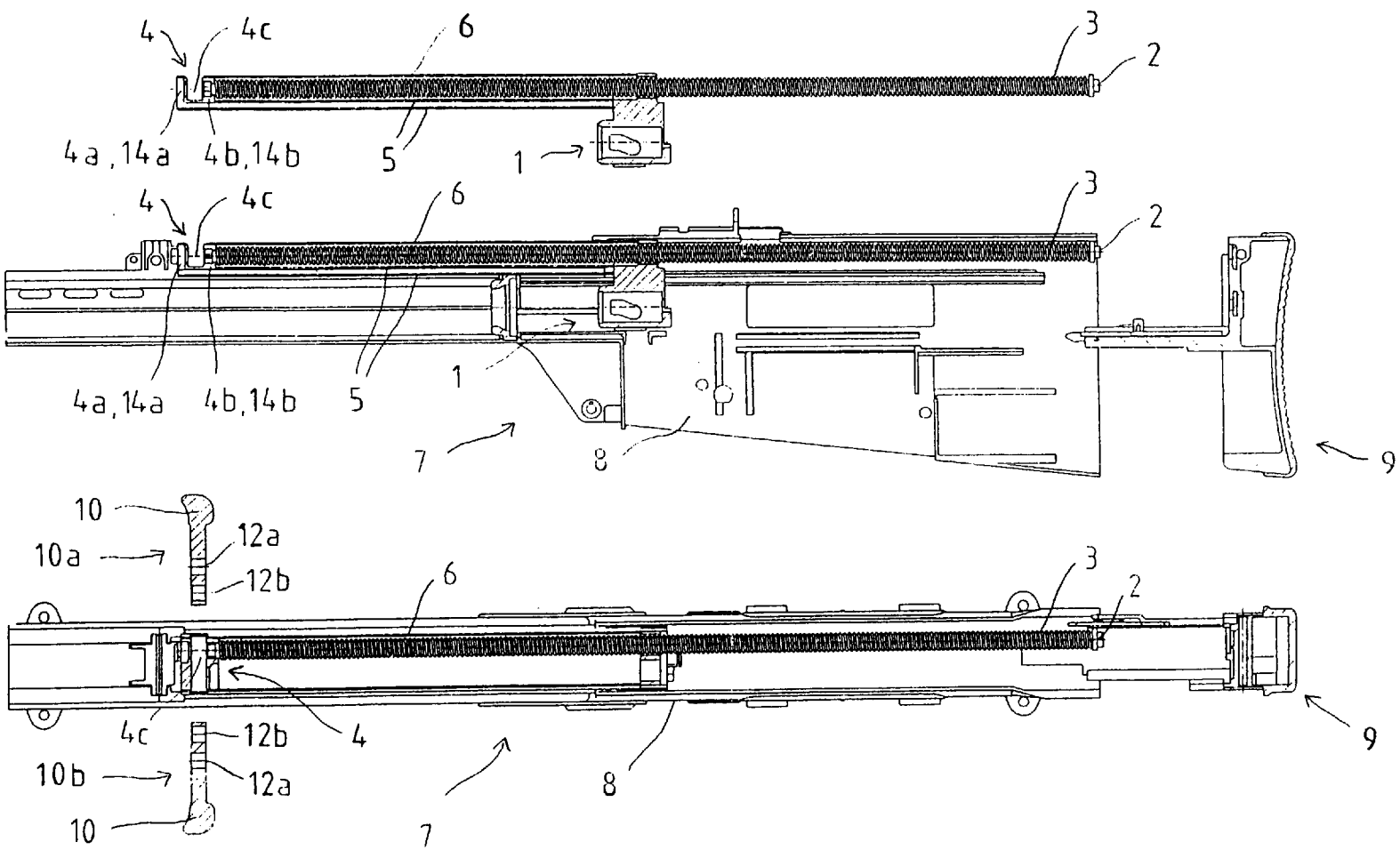
FIG. 1*a* is a side view of an exemplary firing lever arrangement with a retracted spring guide rod and without a firing lever.
FIG. 1*b* is an exemplary weapon housing with the firing lever arranged as depicted in FIG. 1*a* with a disassembled shoulder support.
FIG. 1*c* is a top view of the arrangement of FIG. 1*b* with a firing lever depicted in alternate assembly positions.

FIGS. 1 and 2 show a carrier 4 connected to a bolt carrier 1 by an elongated hollow connector 5. A recoil spring 3 coaxially encloses a spring guide rod 2 and has a front end abutting the carrier 4 and a rear end abutting a shoulder of the spring guide rod 2. A cover 6 formed of a material such as plastic protects the spring guide rod 2 and the corresponding recoil spring 3 from becoming soiled. The carrier 4 has a front abutment 4*a* and a rear abutment 4*b*, each of which is provided with a through hole 14*a*, 14*b* for the spring guide rod 2. When the front end of the spring guide rod 2 is pushed through the through hole 14*b* of the rear abutment 4*b*, the front end of the recoil spring 3 engages the abutment 4*b* and does not pass therethrough.

As shown in FIG. 1*a*, the spring guide rod 2 is retracted so that the front end of the spring guide rod 2 is even with the abutment 4*b*. With the spring guide rod 2 in this position, a transversely running recess 4*c* is exposed between the two abutments 4*a* and 4*b*. A firing lever 10 may be attached by inserting an end of the firing lever 10 into the transversely running recess 4*c* from either side of the firearm, as shown in FIG. 1*c*.

FIG. 1*b* shows the firing lever arrangement of FIG. 1*a* arranged in a firearm 7 of the bullpup design. The carrier 4 extends upward from the weapon housing 8 and is exposed to an exterior of the firearm 7. The cover 6 travels with the bolt carrier 1 and supports the recoil spring 3. To attach the firing lever 10, the spring guide rod 2 must be pushed far enough rearward so that the recess 4*c* is exposed. For this purpose, it is sufficient to move the shoulder support 9, on which the rear end of the spring guide rod 2 is supported, rearward by the required distance. FIGS. 1*b* and 1*c* illustrate a completely disassembled shoulder support 9. The spring guide rod 2 is then automatically pushed rearward by the pressure of the recoil spring 3.

FIG. 1*c* shows a top view of the arrangement depicted in FIG. 1*b*. As is apparent from FIG. 1*c*, the spring guide rod 2 is offset to the right of a center axis of the weapon 7. In the illustrated embodiment, the firing lever 10 has a rigid construction and is shown in its two possible assembled positions 10*a* and 10*b*. The firing lever 10 has two retaining holes 12*a* and 12*b*, which facilitate insertion of the firing lever 10 either side (incorporation positions 10*a* and 10*b*) into the carrier 4. The spring guide rod 2 is inserted through either of the holes 12*a*, 12*b* to fasten the firing lever 10 in place. By providing the two retaining holes 12*a*, 12*b*, it is not necessary to produce a separate firing lever for right- and left-handed use of the weapon, even though the spring guide rod 2 is offset from the center axis.

Figure 2A:
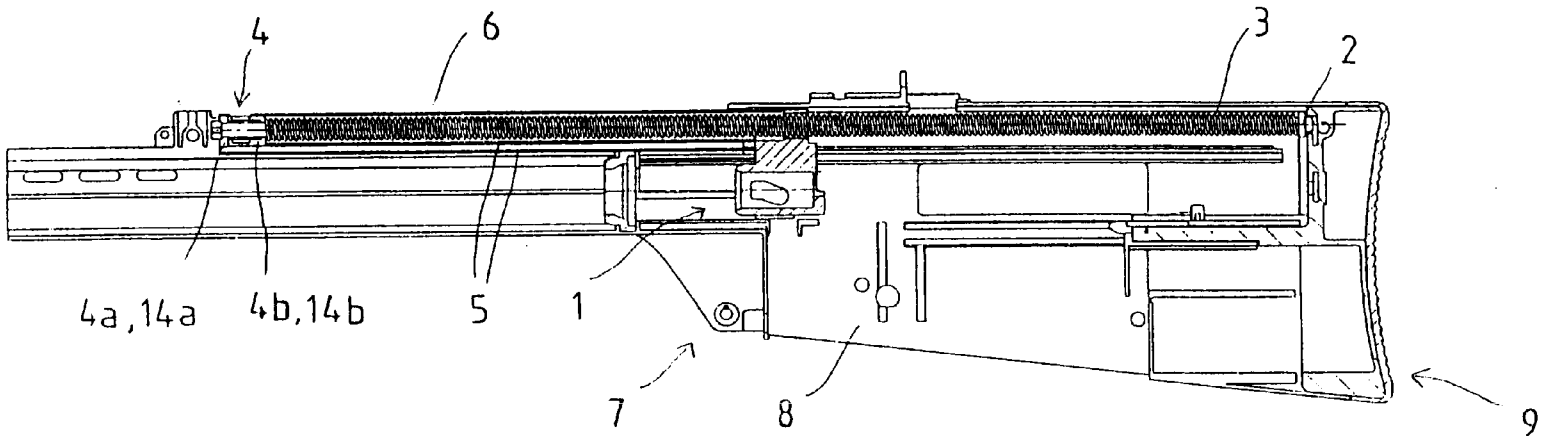
FIG. 2*a* is a side view similar to FIG. 1*b* of an exemplary weapon housing having a firing lever attached on the right side and penetrated by the spring guide rod.
Figure 2B:
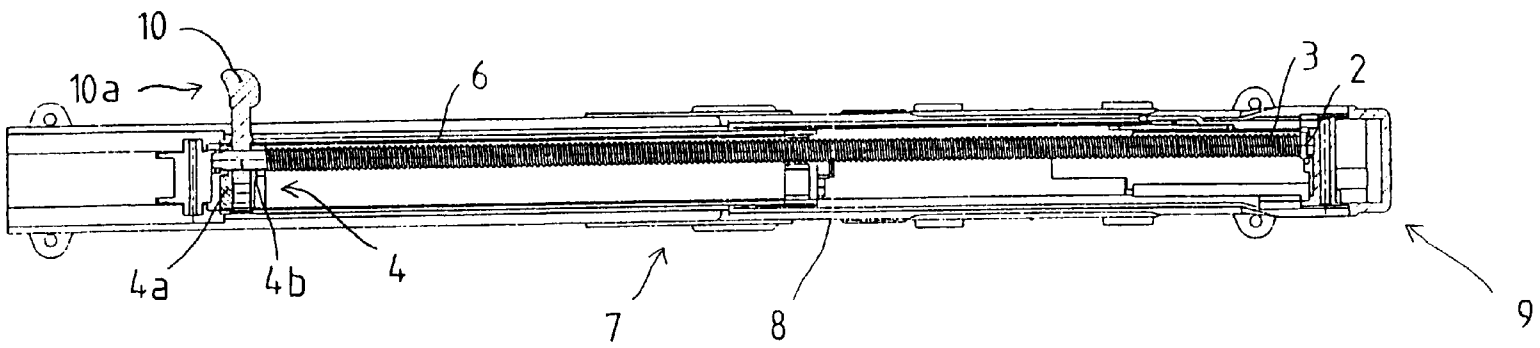
FIG. 2*b* is a top view of the arrangement depicted in FIG. 2*a*.

FIGS. 2*a* and 2*b* are similar to FIGS. 1*b* and 1*c*, respectively, but show the firing lever 10 attached to the firearm 7 in position 10*a*. In addition, the firearm 7 is shown with an assembled shoulder support 9, which forces the spring guide rod 2 forward. The spring guide rod 2 passes through the retaining hole 12*a* of the firing lever 10 to hold the firing lever 10 in position. To convert the weapon from right- to left-handed use and vice versa, a user need only loosen the shoulder support 9 and pull it rearward far enough so that the spring guide rod 2 slides from the retaining hole 12*a* of the firing lever 10. The firing lever 10 may then be removed and inserted from the opposite side, and the spring guide rod 2 is returned to the forward position by pushing the shoulder support 9 forward. The spring guide rod 2 may now extend through retaining hole 12*b*.

Figures 3A, 3B, 3C:
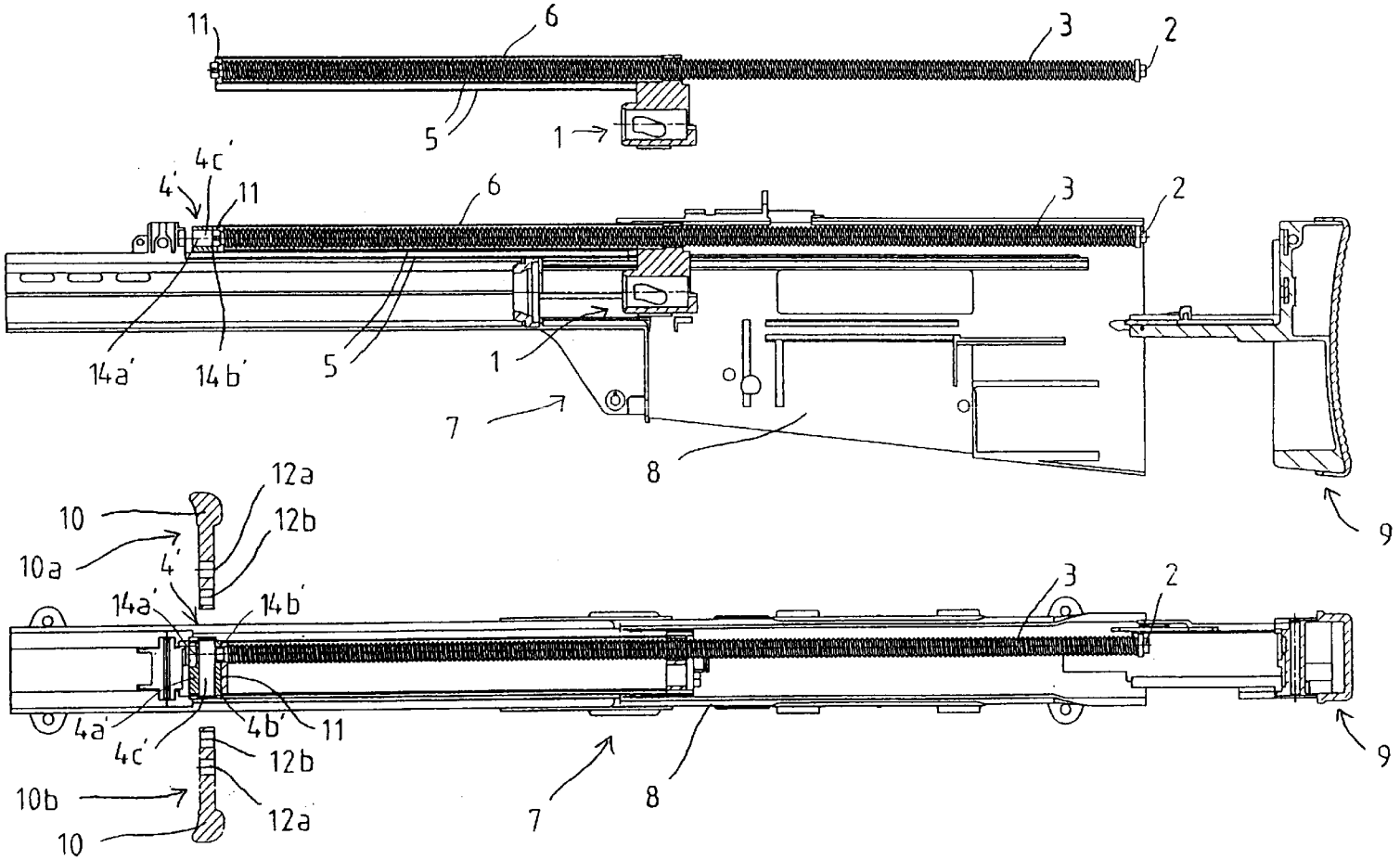
FIG. 3*a* is a side view of another exemplary firing lever arrangement having a retracted spring guide rod with the carrier and firing lever removed.
FIG. 3*b* is side view similar to FIG. 1*b* of an exemplary weapon housing having a carrier and a disassembled shoulder support.
FIG. 3*c* is a top view of the arrangement from FIG. 3*b* with a firing lever depicted in alternate assembly positions.
Figure 4A:
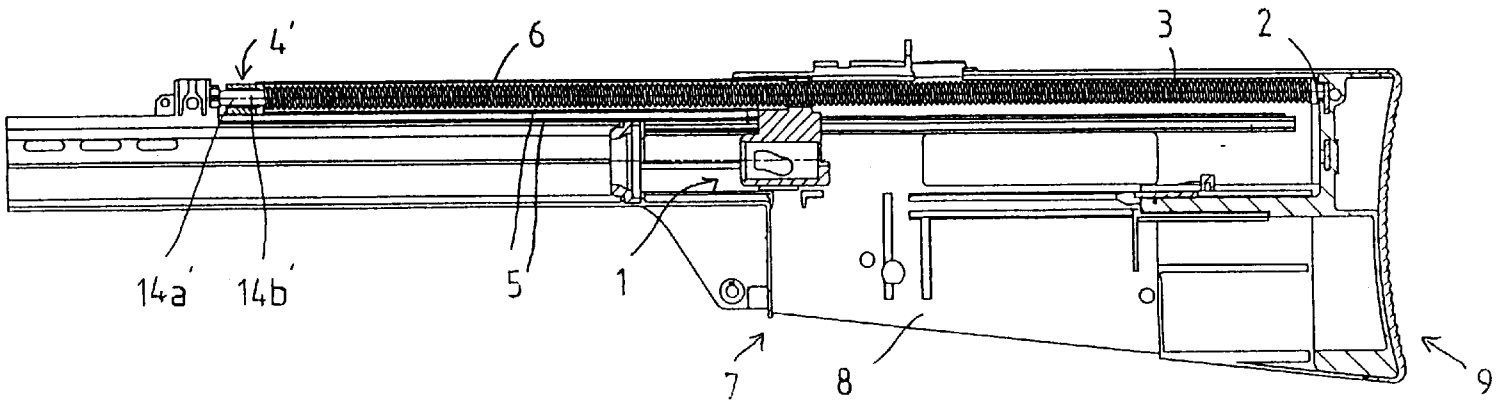
FIG. 4*a* is a side view of the weapon of FIG. 3*b* having an attached shoulder support.
Figure 4B:
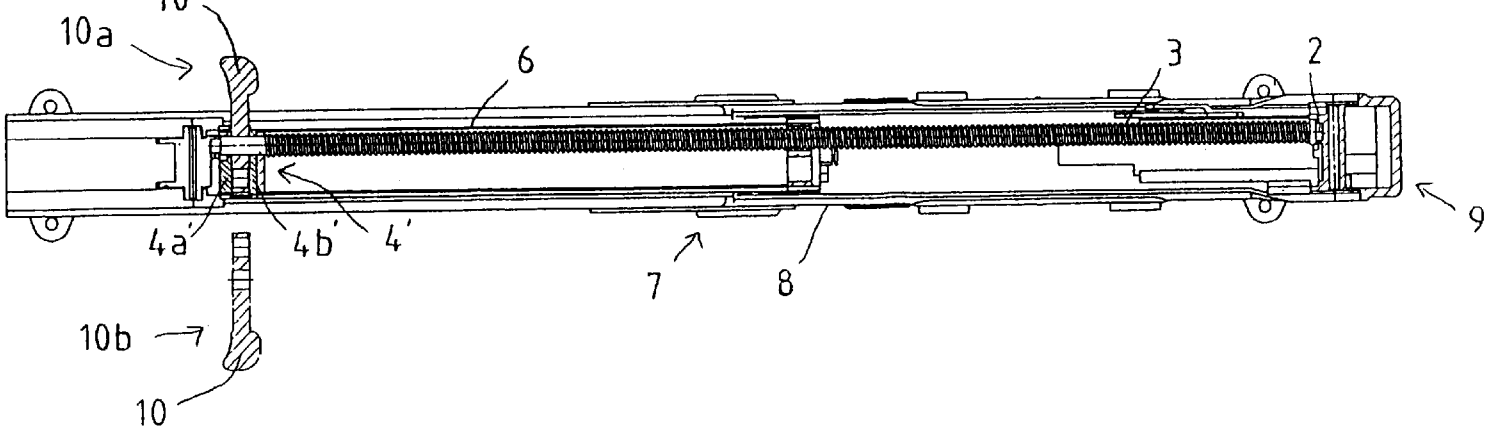
FIG. 4*b* is a top view of the arrangement depicted in FIG. 4*a* with a firing lever depicted in alternate assembly positions.

An alternative firing lever arrangement is shown in FIGS. 3 and 4, which is similar to that shown in FIGS. 1 and 2. The primary difference is that the carrier form 4' is not rigidly connected to bolt assembly 1, but may be moved independently. As a result, once the carrier 4' is reloaded, it remains fixed (i.e., does not move with bolt assembly 1) during shooting.

Similar to the carrier 4, the carrier 4' has two abutments 4*a*' and 4*b*' and a transversely running recess 4*c*' for receiving firing lever 10. In contrast to abutments 4*a*, 4*b* as shown in FIGS. 1 and 2, the abutments 4*a*', 4*b*' are connected to each other above recess 4*c*', and therefore the recess 4*c*' is closed from above. To secure the firing lever 10, the spring guide rod 2 in the assembled weapon 7 passes through one of the retaining holes 12*a* or 12*b* (depending on the incorporation position 10*a* or 10*b*), as well as the through holes 14*a*' and 14*b*' of carrier 4'. The recoil spring 3 is then supported with its front end against an abutment 11 connected to the bolt assembly 1.

From the foregoing, it will be appreciated that a firing lever arrangement is provided in which a recoil spring and a corresponding spring guide rod are provided, and in which the assembled firing lever is secured in position by the spring guide rod. As a result, the firing lever may be converted in simple fashion between right- and left-hand operating positions. At the same time, the firing lever is reliably secured in its corresponding position.

The disclosed embodiments further provide a carrier having a through hole running in the longitudinal direction which is penetrated by the spring guide rod. The recoil spring is then supported with its front end on the carrier or on another component connected to the bolt assembly. As a result, the front end of the recoil spring may be supported directly on the firing lever.

Assembly and disassembly of the weapon, as used herein, are understood to mean standard assembly and disassembly of the weapon as is possible and permitted by the shooter. Extensive assembly or disassembly is not meant, as may be performed only in a shop or at the manufacturer. It is therefore possible in simple fashion to position the firing lever on the side more favorable for the shooter, without requiring a compromise in the form of a center arrangement, as provided in the aforementioned Uzi.

The position of the firing lever provides a clearly marked and visible indication on the exterior of the firearm whether the weapon is set up for right- or left-handed use. In firearms in which the casing ejection must additionally be converted for left-handed use, this advantageously occurs during attachment of the firing lever. Conversion of the casing ejection direction often requires disassembly of the weapon, so that conversion of casing ejection and refitting of the firing lever can occur in one working step.

The carrier and bolt assembly can be joined together in shape-mated or force-fit fashion, especially so that force transfer is possible in the opening and closing direction of the bolt assembly. It is also conceivable to design the bolt assembly, especially the bolt carrier, simultaneously as the (firing lever) carrier and to mount the firing lever with one end directly on the bolt assembly or bolt carrier.

In embodiments where the firing lever does not move with the bolt assembly during shooting, the carrier is designed so that it (and therefore the firing lever) is not force-coupled to the movement of the bolt assembly. For example, the carrier can be arranged so that it may be moved independently of the bolt assembly in the weapon housing and perhaps engages it from the front. After reloading, the carrier returns to its initial position and remains fixed (as in the aforementioned G3 rifle).

The firing lever arrangement as described above permits particularly rigid design of the firing lever. Accordingly, and with appropriate connection between the carrier and bolt assembly, force may advantageously be applied to the bolt assembly in the opening and closing direction in the simplest manner through the firing lever. In addition, the firing lever is always in a usable position and therefore need not be pivoted out for reloading. Thus, the disclosed apparatus is successful in retaining and combining the advantages of several known firing lever arrangements known in the prior art.

Mounting of the firing lever on the carrier can be accomplished in different ways. In principle, both shape-mated and force-fit connections are considered for this purpose. In a preferred embodiment, the carrier defines at least one transversely running recess and the firing lever may be inserted into the recess. The firing lever may thus be alternately introduced into the recess from one or the other side of the carrier. As an alternative, it is conceivable that the carrier has a transversely running recess on both sides, wherein the transversely running recesses being arranged offset one behind the other. After the firing lever is inserted into the transversely running recess, part of the firing lever protrudes above the carrier and may be grasped with the fingers for reloading. In addition, the firing lever may be either rigid or pivotable in a lateral direction.

In a preferred embodiment, the firing lever has at least one retaining hole that extends in the longitudinal direction of the weapon in the incorporated state and is penetrated by the spring guide rod. The retaining hole may be provided in any form that provides a recess that prevents the firing lever from being laterally released in cooperation with the spring guide rod. In addition to a hole-like bore, the retaining hole may be provided in the form of a correspondingly designed retaining edge, for example. To refit the firing lever, it is sufficient to pull the spring guide rod from the retaining hole. The firing lever can then be moved to the other side of the weapon and resecured by reinsertion of the spring guide rod into the retaining hole.

In another preferred embodiment, the spring guide rod, instead of being arranged in the center, is offset from the center axis of the weapon. In this embodiment, attachment and fastening of the firing lever is substantially the same as in previous embodiments. If the firing lever is to be held in position by the spring guide rod offset laterally relative to the center of the weapon, it is advantageous to design the firing lever so that it has two retaining holes. Depending on which side of the carrier the firing lever is then arranged, either one or the other retaining hole is then penetrated by the spring guide rod. Furthermore, the retaining and through holes may be formed with both round and angular cross sections.

In another preferred embodiment, the carrier is arranged in front of the bolt assembly. In this manner, the firing lever is offset forward and the distance to the face of the shooter is increased. The firing lever can thus be mounted on the side of the weapon nearest the face of the shooter so that the shooter need not remove his hand from the grip for reloading. This arrangement is particularly advantageous in weapons of the bullpup design, in which the bolt assembly in the aimed weapon is situated next to or directly in front of the face. The carrier must therefore be offset forward if one intends to mount the firing lever on the side of the weapon nearest the face of the shooter.

Although certain exemplary apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A firearm comprising:

an elongate housing defining a longitudinal direction;

a bolt assembly disposed inside the housing and adapted for movement in the longitudinal direction;

a carrier defining a through hole oriented in the longitudinal direction;

a spring guide rod extending in the longitudinal direction and sized for insertion through the carrier through hole, the spring guide rod being movable between a retracted position and an extended position;

a recoil spring disposed along the spring guide rod;

a firing lever having a first end adapted for insertion into the carrier and defining a first retaining hole sized to receive the spring guide rod;

wherein the spring guide rod in the extended position passes through the firing lever first retaining hole to secure the firing lever in place, and wherein the spring guide rod in the retracted position is withdrawn from the firing lever first retaining hole to allow removal of the firing lever from the carrier.

2. The firearm of claim 1, in which the firing lever has a first position for right-handed use and a second position for left-handed use, and in which the carrier is adapted to receive the first end of the firing lever in both the first and second positions.

3. The firearm of claim 1, in which the carrier defines at least one transversely extending recess and in which the first end of the firing lever is sized for insertion into the recess.

4. The firearm of claim 1, in which the spring guide rod is laterally offset from a center axis of the firearm.

5. The firearm of claim 4, in which the firing lever defines a second retaining hole sized to receive the spring guide rod.

6. The firearm of claim 1, in which the carrier is positioned forwardly of the bolt assembly.

7. The firearm of claim 1, in which the carrier is supported in fixed relation to the bolt assembly, and in which a front end of the recoil spring engages the carrier.

8. The firearm of claim 1, in which an abutment is positioned rearwardly of the carrier, and in which a front end of the recoil spring engages the abutment.

9. A firing lever assembly for use in a firearm having a housing extending in a longitudinal direction and a bolt assembly adapted for longitudinal movement within the housing, the firing lever assembly comprising:

a carrier defining a through hole;

a firing lever having a first end adapted for insertion into the carrier;

a spring guide rod sized for insertion into the carrier through hole and adapted for longitudinal movement between an extended position and a retracted position;

a recoil spring disposed about the spring guide rod;

wherein the spring guide rod in the extended position engages the firing lever to secure the first end of the firing lever in the carrier, and wherein the spring guide rod in the retracted position is disengaged from the firing lever to allow removal of the firing lever from the carrier.

10. The firing lever assembly of claim 9, in which the firing lever has a first position for right-handed use and a second position for left-handed use, and in which the carrier is adapted to receive the first end of the firing lever in both the first and second positions.

11. The firing lever assembly of claim 9, in which the carrier defines at least one transversely extending recess and in which the first end of the firing lever is sized for insertion into the recess.

12. The firing lever assembly of claim 9, in which the firing lever defines a first retaining hole sized to receive the spring guide rod, and in which the spring guide rod extends through the firing lever retaining hole in the extended position.

13. The firing lever assembly of claim 12, in which the spring guide rod is laterally offset from a center axis of the firearm.

14. The firearm of claim 13, in which the firing lever defines a second retaining hole sized to receive the spring guide rod.

15. The firearm of claim 9, in which the carrier is positioned forwardly of the bolt assembly.

16. The firearm of claim 9, in which the carrier is supported in fixed relation to the bolt assembly, and in which a front end of the recoil spring engages the carrier.

17. The firearm of claim 9, in which an abutment is positioned rearwardly of the carrier, and in which a front end of the recoil spring engages the abutment.

* * * * *